US009751339B2

(12) United States Patent
Campanini

(10) Patent No.: US 9,751,339 B2
(45) Date of Patent: Sep. 5, 2017

(54) ANTI-JAMMING DEVICE FOR PRINTING APPARATUSES WITH STACKER

(71) Applicant: CUSTOM S.P.A., Fontevivo (Parma) (IT)

(72) Inventor: Alberto Campanini, Fidenza (IT)

(73) Assignee: CUSTOM S.P.A., Fontevivo (Parma) (IT)

( * ) Notice: Subject to any disclaimer, the term of this patent is extended or adjusted under 35 U.S.C. 154(b) by 0 days.

(21) Appl. No.: 15/175,909

(22) Filed: Jun. 7, 2016

(65) Prior Publication Data

US 2016/0355035 A1 Dec. 8, 2016

(30) Foreign Application Priority Data

Jun. 8, 2015 (IT) ..... 102015000021306

(51) Int. Cl.

| | |
|---|---|
| ***B65H 26/02*** | (2006.01) |
| ***B41J 11/00*** | (2006.01) |
| ***B41J 11/70*** | (2006.01) |
| ***B65H 20/32*** | (2006.01) |
| ***B65H 29/46*** | (2006.01) |

(Continued)

(52) U.S. Cl.

CPC ..... *B41J 11/006* (2013.01); *B41J 11/70* (2013.01); *B65H 20/32* (2013.01); *B65H 26/02* (2013.01); *B65H 29/46* (2013.01); *B65H 31/06* (2013.01); *G07B 5/08* (2013.01); *G07F 17/24* (2013.01); *G07G 5/00* (2013.01); *B41J 2/32* (2013.01); *B41J 11/42* (2013.01);

(Continued)

(58) Field of Classification Search

CPC . B41J 11/70; B41J 11/006; B41J 11/42; B41J 2/32; G07F 17/24; G07G 5/00; B65H 31/06; B65H 26/02; B65H 29/46; B65H 20/32; B65H 2701/1936; B65H 2301/4213; B65H 2301/51212; G07B 5/08

See application file for complete search history.

(56) References Cited

U.S. PATENT DOCUMENTS 4,971,302 A * 11/1990 Morii ..... B42C 1/125 270/58.14
6,428,226 B1 * 8/2002 Suzuki ..... B41J 13/106 400/619

(Continued)

FOREIGN PATENT DOCUMENTS

| | | |
|---|---|---|
| EP | 1676708 A1 | 7/2006 |
| JP | S4980766 A | 8/1974 |

OTHER PUBLICATIONS

European Search Report Application No. ITUB20151220 Completed: Feb. 12, 2016 4 pages.

(Continued)

*Primary Examiner* — Manish S Shah
*Assistant Examiner* — Yaovi M Ameh
(74) *Attorney, Agent, or Firm* — Whitmyer IP Group LLC

(57) ABSTRACT

It is disclosed an anti-jamming device for a printing apparatus with stacker, for lottery or betting terminals, with a path of a continuous strip of paper, a printing device for printing a document on the strip, a cutting device for separating the document from the strip, a movement device for moving the document laterally to a stacking zone, a movable portion that bounds the path and is moved from the strip in the event of a jam, moving the portion causing printing to be stopped.

11 Claims, 5 Drawing Sheets

(51) Int. Cl.

| | |
|---|---|
| ***B65H 31/06*** | (2006.01) |
| ***G07B 5/08*** | (2006.01) |
| ***G07F 17/24*** | (2006.01) |
| ***G07G 5/00*** | (2006.01) |
| *B41J 2/32* | (2006.01) |
| *B41J 11/42* | (2006.01) |

(52) U.S. Cl.
CPC ..... *B65H 2301/4213* (2013.01); *B65H 2301/51212* (2013.01); *B65H 2701/1936* (2013.01)

(56) References Cited

U.S. PATENT DOCUMENTS

| | | | |
|---|---|---|---|
| 8,177,232 | B2 | 5/2012 | Supron |
| 2003/0089209 | A1 | 5/2003 | Brueckel et al. |

OTHER PUBLICATIONS

Italian Written Opinion Application No. ITUB20151220 Completed: Feb. 12, 2016 9 pages.

* cited by examiner

ANTI-JAMMING DEVICE FOR PRINTING APPARATUSES WITH STACKER

TECHNICAL FIELD

The invention relates to an anti-jamming device for printing apparatuses with stacker, in particular for printing apparatuses having a cutting device, which is arranged for separating a printed document from a continuous strip, and a stacking zone where the printed documents are stacked on one another.

BACKGROUND

Specifically, but not exclusively, the invention can be applied to prevent a paper jam during the formation of a stack or a group of documents (for example tickets, payment slips, receipts, coupons, vouchers, etc) printed on a continuous strip of paper and then separated from the strip itself, in particular for lottery or betting terminals.

In particular, reference is made to a stacker of a printing apparatus provided with an anti-jamming device that is suitable for preventing a jam caused by anomalous advancement of the strip due to, for example, maximum capacity of the stacker being reached or to a blockage in the stacking zone.

The prior art comprises patent publication U.S. Pat. No. 8,177,232 that shows an apparatus for stacking tickets in a ticket printer with a stacking actuator that receives the printed ticket and supplies the printed ticket to a stacking container through a main ticket exit, with a stacking diverter that guides the ticket to the correct stacking position, and with an anti-jamming device having an alternative ticket exit arranged between the actuator and the stacking diverter, in which, if the stacking container has reached maximum capacity, or if the main ticket exit is blocked, the ticket forms a loop that extends outside through the alternative ticket exit.

From patent publication EP 1676708 an anti-jamming device for printers located in public places is known, with a rise arranged in an exit conduit of the paper and with a door arranged in the zone where the paper is raised because of the rise in the event of an occlusion of the exit; the door is provided with electric contacts that are openable following lifting of the door, which lifting is actuated by the paper, to temporarily stop advancement of the paper.

One of the problems of the apparatuses of the prior art that print the documents and arrange the documents in an orderly manner in a stacking container, is the jam caused by the maximum capacity reached in the stacking container, or by any other type of occlusion near the stacking zone.

Document U.S. Pat. No. 8,177,232 proposes a solution to this problem. This solution nevertheless has some limits and drawbacks.

Firstly, an alternative ticket exit has to be provided, with resulting structural complication of the apparatus. The presence of another ticket exit, in addition to the main exit, increases the risk of intrusion of foreign bodies into the printing apparatus. Further, in the anti-jamming device disclosed in U.S. Pat. No. 8,177,232, the ticket has to form a loop that is sufficiently extended to exit through the alternative ticket exit, with the risk of incorrect operation.

SUMMARY

One object of the invention is to make a printing apparatus that is able to overcome one or more of the aforesaid limits and drawbacks of the prior art.

One object of the invention is to provide a printing method that is able to overcome one or more of the aforesaid limits and drawbacks.

One advantage is providing an anti-jamming device that is able to avoid with efficacy and reliability the formation of jams in a printing apparatus provided with an automatic stacking device of the printed documents.

One advantage is to give rise to a printing apparatus with an automatic device for stacking the printed documents and with an anti-jamming device to avoid jamming in the stacking zone.

One advantage is to have an anti-jamming device, for printing apparatuses with an automatic stacker, which is constructionally simple and cheap.

One advantage is to make available a printing apparatus with an automatic stacker and anti-jamming device of relatively reduced dimensions.

Such objects and advantages, and still others, are achieved by the apparatus and by the method according to one or more of the claims set out below.

In one example, a printing apparatus comprises a path of a continuous strip, a printing device for printing a document on the strip, a cutting device for separating the document from the strip, a movement device for moving the printed document to a stacking zone, an anti-jamming device having a movable portion that is arranged on a side of said path and is moved from the strip in the event of a jam, a control arrangement for stopping the advancement of the strip when said movable portion is moved. This movable portion can be arranged, in particular, at a path portion of the strip comprised between the cutting device and the movement device.

BRIEF DESCRIPTION OF THE DRAWINGS

The invention can be better understood and implemented with reference to the attached drawings that illustrate an example thereof by way of non-limiting example.

DETAILED DESCRIPTION

Figure 1:
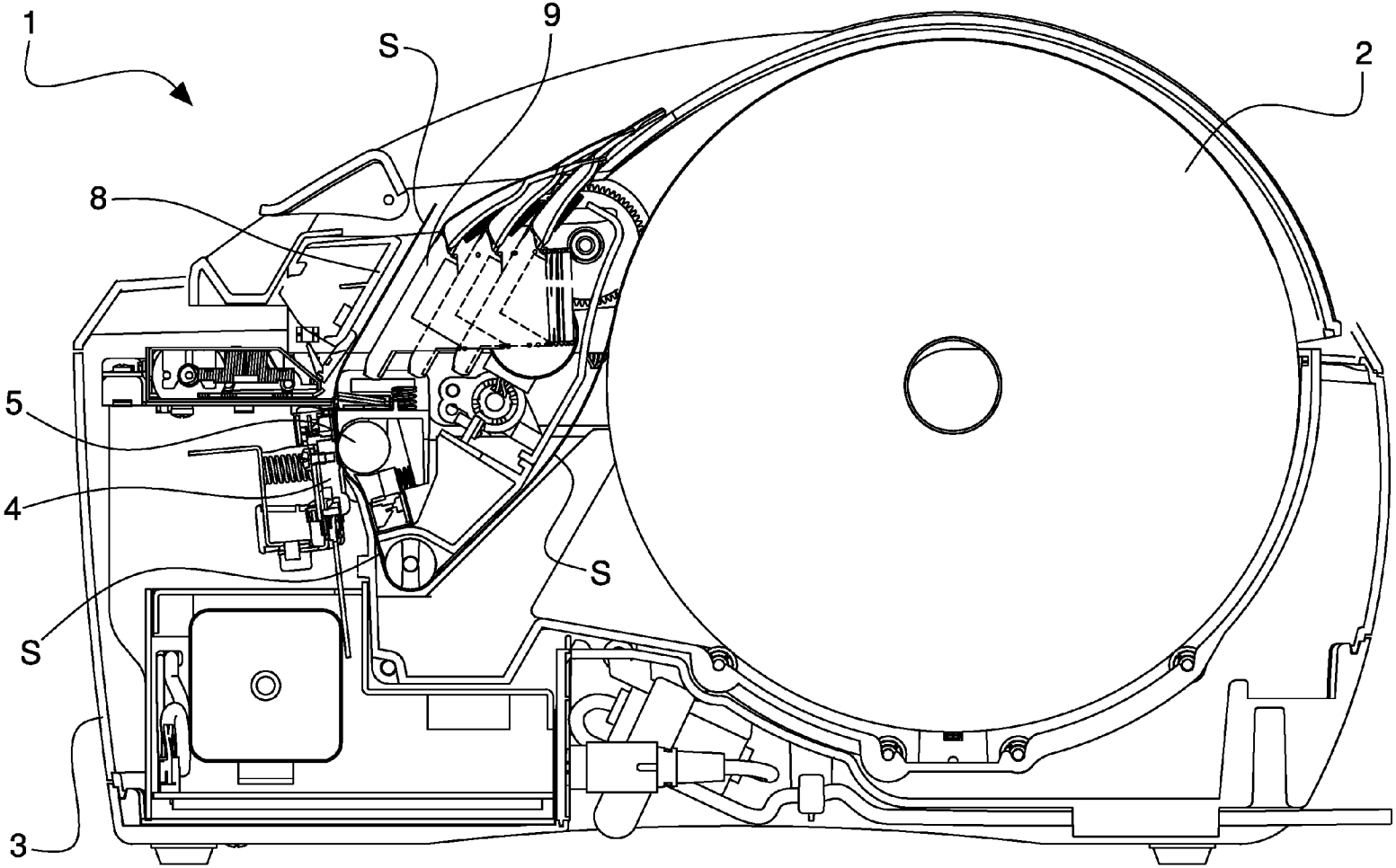
FIG. 1 is a section in a vertical elevation of one embodiment of a printing apparatus made according to the invention.

With reference to the aforesaid figures, overall with 1*a* printing apparatus has been indicated that is usable in particular to print tickets, payment slips, receipts, vouchers, coupon, or other types of document printed in real time. The printing apparatus 1 can be used, in particular, in a lottery or betting terminal.

The printing apparatus 1 can comprise, in particular, a magazine 2 for housing printing paper or another type of printing support. The printing support that is usable by the printing apparatus 1 in question can be, in particular, paper, for example thermal paper. In this patent text, "paper" is any type of printing support that is suitable for printing (in particular with a thermal printing head or inkjet), for example a printable material in the form of a strip, in particular wound on a reel, as a reel of (thermal) paper. In this patent text, "strip" is not only a strip of paper unwound from a reel but also other types of printing supports (of known type), such as, for example, a set of sheets in continuous fan-fold format, or a set of sheets (for example labels) arranged in a row on a support in the form of a strip, etc.

In the specific case the magazine 2 can comprise, in particular, at least one seat arranged for receiving at least one reel of (thermal) paper. The magazine can nevertheless comprise other examples of paper magazines (also of known type).

The printing apparatus 1 can comprise, for example, a containing body, or casing 3, (for example of box shape) suitable for containing the various components of the printing apparatus itself or at least a part thereof.

The printing apparatus 1 can comprise, in particular, a path for supplying a continuous strip S of paper coming from the magazine 2 (strip 5 unwound from a reel) to a cutting zone of the printed document.

The printing apparatus 1 can comprise, in particular, a printing device for printing a document on the strip S of paper that advances (unwound from the reel). The printing device can comprise, for example, a (thermal) printing head 4 arranged along the path of the strip S of paper to print at least on a first face of the paper (for example a thermally sensitive face). In the specific case, a thermal printing head 4 is arranged, but it is possible to provide for the use of a printing device of the inkjet or of yet another type.

With the printing head 4, a printing roller 5 (paper dragging roller) can be operationally associated that is opposite the printing head 4. The printing roller 5 can operate in contact with a second face of the paper (opposite the first printable face). The path of the strip S of paper passes, in particular, between the printing head 4 and the printing roller 5. The printing roller 5 can be controlled (by a programmable electronic control arrangement) cooperating with the printing head 4, to advance the strip S in a coordinated manner during the document printing step.

The printing apparatus 1 can comprise, in particular, a cutting device for separating the printed document D from the rest of the strip S when the document is (stationary) in a cutting position. The cutting device can comprise, for example, a driven movable blade 6 cooperating with a stationary blade 7.

The printing apparatus 1 can comprise, in particular, a stacking device for stacking the printed documents separated from the strip S.

Figure 5:
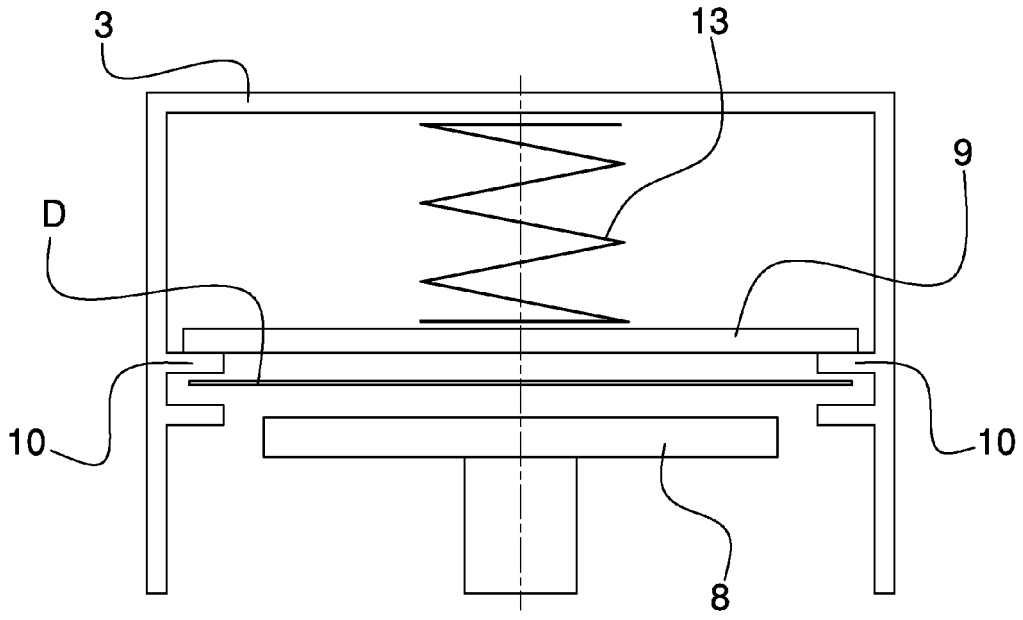
FIG. 5 is a diagram of the stacking device of the printing apparatus in FIG. 1 in a rest position.
Figure 6:
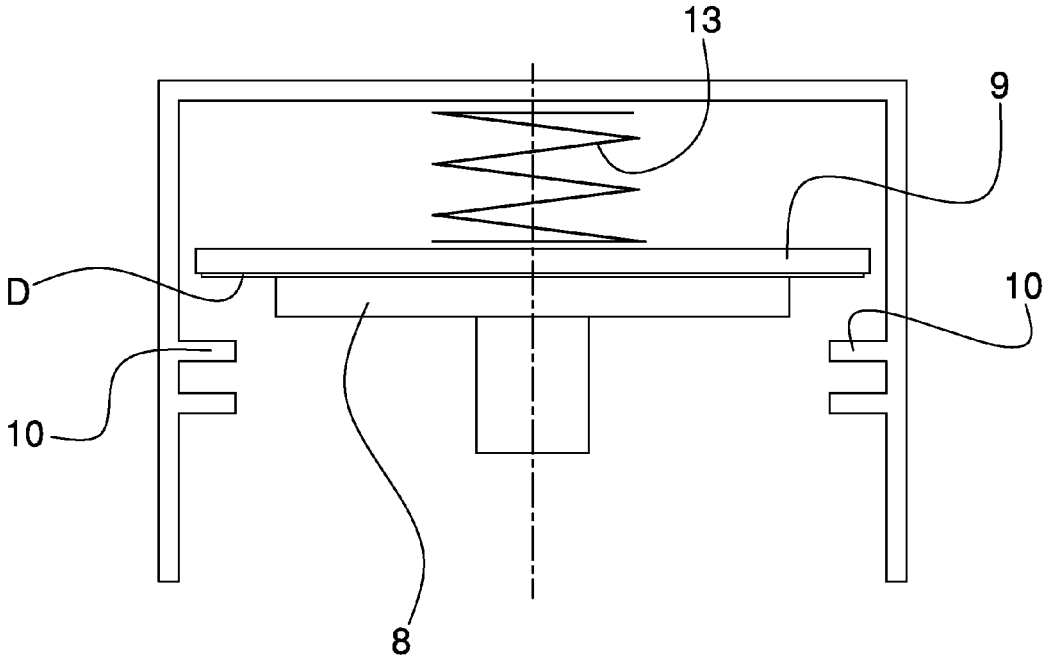
FIG. 6 shows the diagram of FIG. 5 in a work position.

The stacking device can comprise, in particular, a movement device for moving the document laterally D (already separated from the rest of the strip). Document D can be moved, in particular, from the cutting position (FIG. 5) to a stacking position in which two or more printed documents can be stacked on one another to be easily grasped and/or handled by a user. A "lateral" movement is a movement in a transverse (for example substantially perpendicular) direction to the surface of the document. In particular a "lateral" movement can be a movement in a direction that is transverse to the normal advancement direction of the paper if the paper is dragged by the dragging rollers.

The movement device can comprise, as in this example, at least one pusher 8 that moves the document laterally from the cutting position to the stacking position. The pusher 8 can have, in particular, a reciprocating motion with a forward stroke for moving the document laterally to the stacking position and a return stroke for returning to a suitable position for moving the next document laterally. The pusher 8 can comprise, for example, at least one contact portion arranged in contact on a face (printed previously by the printing device) of the document to push the document in a direction that is transverse (perpendicular or tilted) to the document to perform the lateral movement.

The contact portion can define, in particular, a (flat) surface that acts against a face of the document. The contact portion can operate, in particular, in a central zone of the face of the document comprised between the side edges thereof. The contact portion can be, as in this example, tilted in the direction of the motion of the portion, so as to promote the detachment of the document from the cutting device after cutting.

The printing apparatus 1 can comprise, in particular, at least one movable stacking wall 9 arranged in the stacking zone to keep document D pressed that is situated in the stacking position against an abutting arrangement 10. The stacking wall 9 can be, as in this specific example, secured (for example to the case 3 or to another component of the printing apparatus) by a slidable coupling (in particular with linear sliding).

Figure 2:
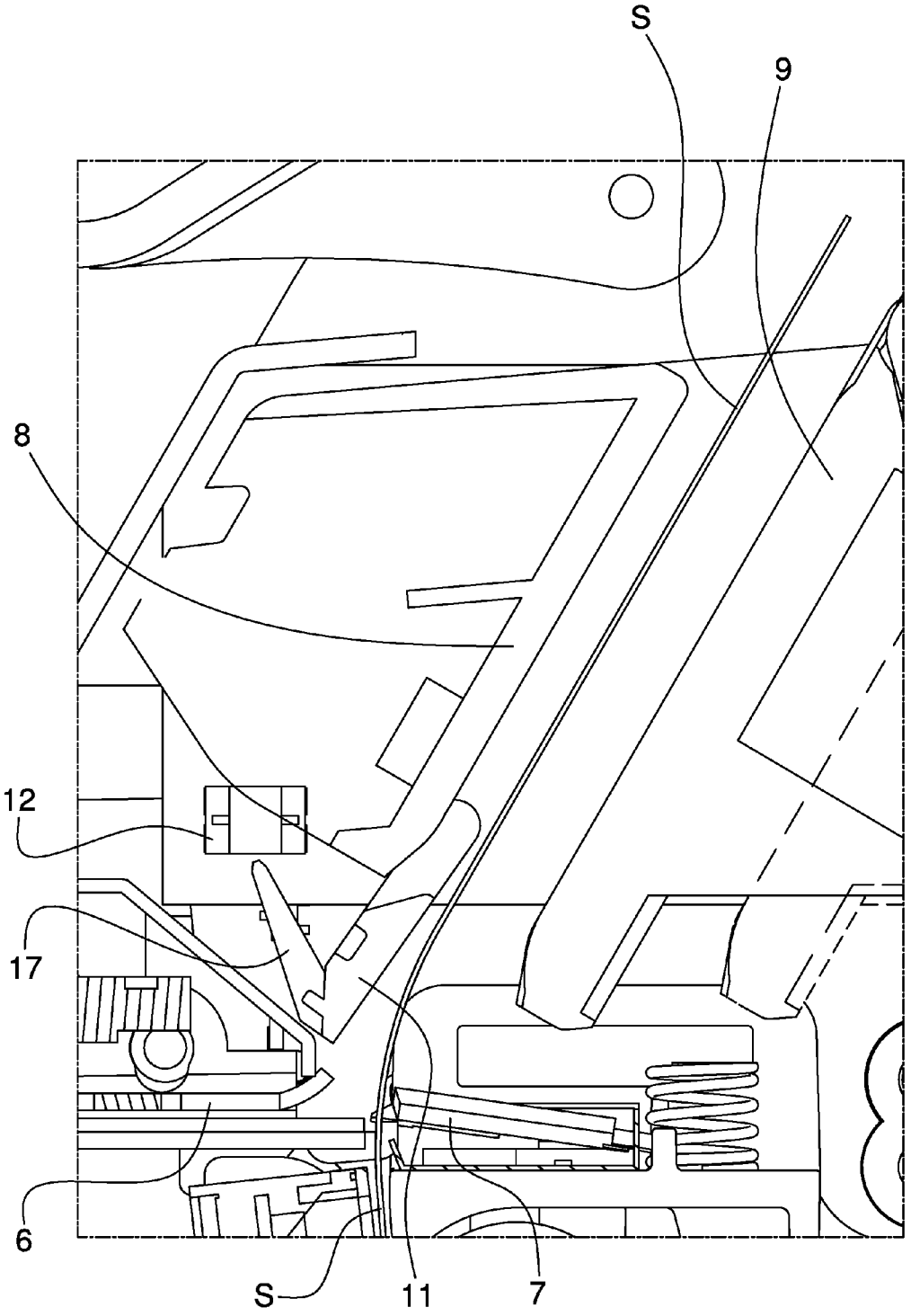
FIG. 2 shows an enlarged detail of FIG. 1.
Figure 3:
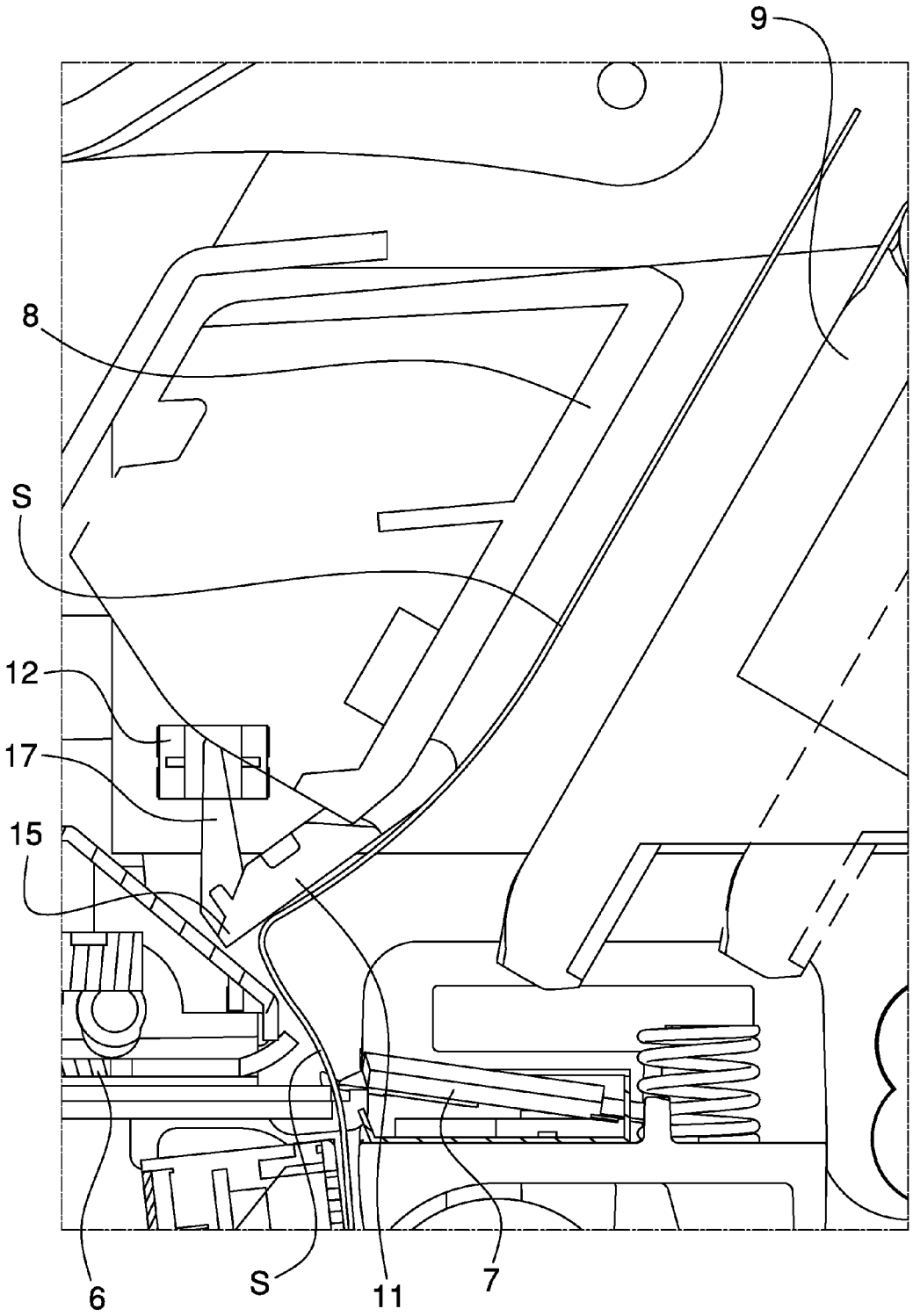
FIG. 3 shows the detail of FIG. 2 in a different operating configuration in which the movable portion of the anti-jamming device has been moved from the strip that has met an obstacle advancing to the cutting position.
Figure 4A:
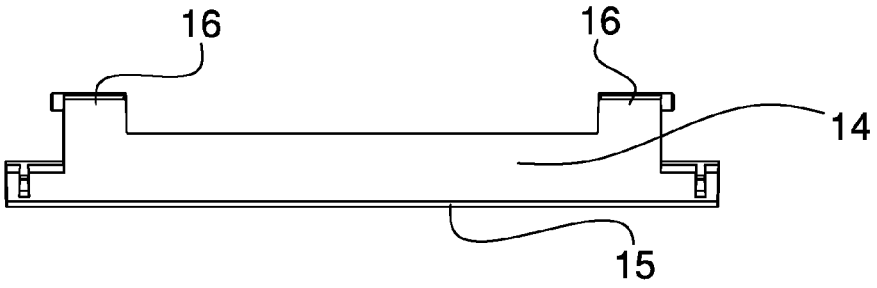
FIGS. 4A to 4D show four different views of the movable portion of the anti-jamming device of the printing apparatus in FIG. 1.
Figure 4B:
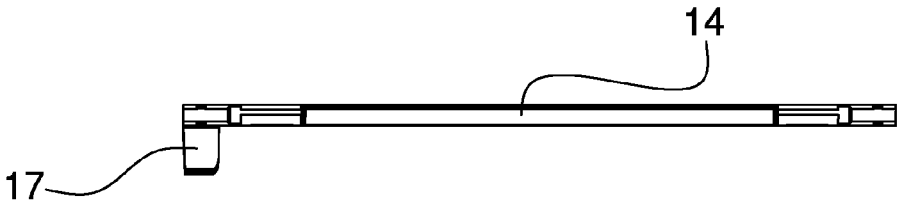
Figure 4C:
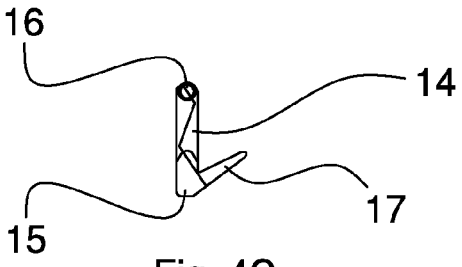
Figure 4D:
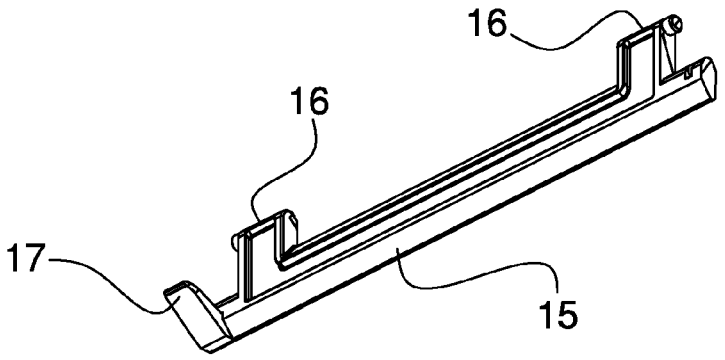

In particular, the stacking wall 9 can be arranged for retracting, pushed by the movement device, when the latter pushes document D laterally to the stacking position. The wall 9 can be arranged for returning (elastically) to a suitable position for keeping the document pressed against the abutting arrangement 10 when the movement device returns to the rest position to be ready to move the next document laterally. The stacking wall 9 can be provided with an elastic arrangement 13 (for example at least one coil spring arranged between the wall 9 and the case 3 of the apparatus) that pushes the wall against the abutting arrangement 10. The elastic arrangement 13 can be arranged, for example, in such a manner as to operate in contrast with the lateral movement action performed by the movement device. In FIGS. 1 to 3, the wall 9 is drawn with a continuous line in the advanced end position (further to the left in FIGS. 1 to 3), in which the wall is, between the elastic arrangement 13 and the abutting arrangement 10, when the stacking zone is empty of documents, and is drawn with a dashed line in increasingly retracted positions (further to the right in the figures), in which the wall 9 is located when in the stacking zone there are more and more stacked documents.

The stacking wall 9 can be, in particular, wider than a free space for the passage of paper comprised between two side protrusions of the abutting arrangement 10. This free space represents, in other words, a gap left free in the centre between the two protrusions and through which the document passes when it is moved from the cutting position to the stacking position.

The stacking wall 9 can maintain the documents securely locked in the stacking position, pressing the documents against the abutting arrangement 10 with such a force as to ensure the stability of the stack of documents, in particular to prevent the drop of a document by gravity (for example a very long document), but such as to enable the stacked documents to be removed comfortably or be handled at will.

The elastic arrangement 13 of the wall 9 can be calibrated in such a manner as to exert the appropriate force. The aforesaid elastic arrangement 13 can also be so calibrated that the wall 9 can easily retract, at least slightly, pushed by the forward stroke of the movement device, i.e. during the step of moving a document D from the cutting position to the stacking position, to permit and ensure the passing of the abutting arrangement 10 by the moved document.

The printing apparatus 1 can comprise, in particular, an anti-jamming device to prevent a jam of the apparatus caused by an anomalous or undesired situation that can take place along the path of the strip, in particular in the stacking zone. This anomalous or undesired situation can comprise, for example, the maximum capacity reached in the stacking zone or an obstruction (for example an object outside the apparatus) in the stacking zone.

The anti-jamming device can comprise, in particular, a movable portion 11 that can adopt a normal position, in which the portion 11 is arranged on a side of a part of the path of the strip S, and an anomalous position, in which the portion 11 moves laterally away from this part of the path. A movement of the movable portion 11 from the normal position to an anomalous position can be caused, for example, by the strip S that folds laterally (forming a loop) because of the anomaly (clogging or occlusion) on the path of the strip.

The path of the strip can comprise, as in this example, a curve arranged at the movable portion 11. The path of the strip can comprise, in particular, a guiding arrangement (for example a strip guiding channel) having a curve for forcing the strip to follow the curved path. The strip can be guided to follow the curve by virtue of the shape of the guide channel. In particular, the strip that exits the printing zone and/or the cutting zone can have an advancement direction that is different from a lie direction of the strip in the cutting position. In particular, the aforesaid advancement direction in the printing zone and/or in the cutting zone can form, with the aforesaid lie in the cutting position, an angle greater than 5°, or 10°, or 15°, or 20°. The aforesaid curve of the path of the strip is arranged in such a manner as to contribute to modifying the orientation of the strip from the aforesaid advancement direction to the aforesaid lie direction.

The aforesaid curve in the path of the strip is arranged in such a manner as to have the convex side facing the movable portion 11. In this manner, the curve of the strip is an invitation that induces the strip to fold laterally (forming a loop that moves the portion 11) owing to an anomaly on the path. In substance, the aforesaid curve constitutes a sort of trigger that promotes the further folding of the strip outwards to move the portion 11 in the event of an anomaly.

The (electronic and programmable) control arrangement of the printing apparatus 1 can be configured for stopping the advancement of the strip S when the movable portion 11 adopts the aforesaid anomalous position.

The movable portion 11 can be arranged, as in this example, before the movement device (pusher 8), with reference to an advancement direction of the strip S along the path to the cutting position. The movable portion 11 can be arranged, in particular, after the cutting device (blades 6 and 7), with reference to an advancement direction of the strip S along the path to the cutting position. The aforesaid advancement direction can have, as in this case, a component of the vertical motion oriented upwards. In particular, the path of the strip S can be oblique, being configured in such a manner that the strip S advances in a tilted direction upwards from the start to the end of the aforesaid part of path, i.e. for the entire length of the path part in which the movable portion 11 is adjacent to the path. The movable portion 11 can be arranged, as in this example, facing the upper side (upward facing) of the strip S that is in the aforesaid oblique path part. The lower side (downward facing) of the strip S can, as in this example, face one of the blades of the cutting device, in particular face the stationary blade 7.

The cutting device (blades 6 and 7) can be arranged, as in this example, below the cutting position. The cutting device (blades 6 and 7) can be arranged, as in this example, below the movable portion 11.

The movable portion 11 can comprise, as in this example, a wall of substantially flat shape 14, in particular made of plastics. The movable portion 11 can comprise, as in this example, at least one (lower) flat surface intended for contact with the strip S if the strip S is folded through the effect of the anomalous situation. The movable portion 11 can in particular extend in width for the entire width of the strip S or at least for most of the width of the strip S.

The movable portion 11, in the normal position, can have, as in the specific example disclosed here, a lower end 15 nearer the cutting device and an upper end 16 further from the cutting device.

The movable portion 11, in the normal position, can be arranged tilted (oblique). The movable portion 11, in the normal position, can be tilted at substantially the same angle of tilt (with a difference within a range of ±10° or ±20°) with respect to an angle of tilt of the documents in the cutting position and/or in the stacking position, in particular with respect to an angle of tilt of the stacking wall 9. The movable portion 11, in the normal position, can be oriented in such a manner as to form an angle that is less than 90° with a (linear) direction of movement of the movable blade 6.

The upper end 16 of the movable portion 11 can be, for example, hinged on the case 3. The lower end 15 of the movable portion 11 can be free and rest against an abutment (a fixed abutment, for example an abutment arranged on the case 3). A movement of the movable portion 11 from the normal position to the anomalous position can comprise an oscillation or rotation of the portion around the hinge or pivot arranged on the upper end 16.

The anti-jamming device can comprise a sensor arrangement 12 arranged for detecting the anomalous position of the movable portion 11. This sensor arrangement 12 can comprise, in particular, a presence or proximity sensor arrangement. This sensor arrangement 12 can comprise, as in this example, at least one switch or an electric contact that opens or closes when the movable portion 11 is moved to the anomalous position. The sensor arrangement 12 can comprise a sensor arrangement of another type, for example of optical, magnetic or ultrasound etc type.

The movable portion 11 can comprise a protrusion 17, for example with the shape of a tooth or nail that is detected by the sensor arrangement 12. The protrusion 17 protrudes transversely from a longitudinal axis of the movable portion 11 (axis parallel to the rotation axis around which the movable portion 11 oscillates or rotates).

In operation, during printing of a document, the advancing strip S being dragged by the printing roller 5 may meet an obstacle downstream of the cutting device, for example an obstacle represented by a previously printed document that has not reached the stacking position correctly (for example a preceding document that may still be in the cutting position because the stacking wall 9 has already reached maximum available capacity).

In this case, when the advancing strip S finds the obstacle it is folded (forming a loop) facing the movable portion 11. The latter is pushed by the strip S, so that the movable portion 11 will move outwards (rotating around the upper hinge, in the embodiment in FIGS. 1 to 3, clockwise).

The sensor arrangement 12 will detect the movement of the movable portion 11, emitting a signal to the control arrangement, which is programmed to interrupt the advancement of the strip S to stop the printing device.

The electronic control arrangement can be programmed to count a preset wait period (for example a wait period greater than 10 seconds or 30 seconds, or of 1 minute and/or less than 30 seconds, or 1 minute, or 2 minutes) during which, if the portion 11 returns to the normal position, the same printing operation that had been stopped is resumed (from where it stopped) so as to complete printing without graphic interruption of printing of the document. In practice, if the anomalous situation (obstacle in the stacking zone) is removed in time (within the wait period), the situation is immediately recoverable without losing the document printing operation and without any substantial repair operation.

During the wait period, the electronic control arrangement can be programmed to emit a first alarm signal to signal a stop of the apparatus due to a non-prolonged anomaly (recoverable without graphic interruption of the printing of the document). If, after the preset wait period, the anomalous situation is not resolved, the electronic control arrangement can be programmed to emit a second alarm signal, different from the first, to signal a stop of the apparatus due to a prolonged anomaly.

As said, in the case of an obstacle in the stacking zone, the advancement of the strip S is stopped and consequently the strip forms a loop, in particular at the trigger formed by the curve of the path arranged next to the portion 11. The loop, which is due to the anomalous advancement of the strip caused by an obstacle on the path, moves the portion 11 from the normal position to the anomalous position. The loop represents, in substance, an accentuation of the curve normally provided on the path of the strip.

If the obstacle is removed within the aforesaid wait period, the strip S can return spontaneously to the original position by virtue of the elasticity of the material (paper) of the strip S, making the loop disappear, which returns elastically to the original shape, in which the path is only slightly curved. For this reason, interrupting the advancement of the strip must be timely, such that the loop of the strip does not acquire excessive curvature, i.e. curvature that is such as to exceed the zone of elasticity of the strip, beyond which the strip can no longer return to the original position, i.e. return from the loop shape in an anomalous situation, to the slightly curved shape in a normal situation.

If the obstacle is removed, it is the movable portion 11 that can promote the return of the strip to the original position, by cooperating with the action of the elasticity of the paper. In particular, the portion 11 can be arranged (as in the embodiment illustrated here) in such a manner as to promote the return of the strip to the normal position through the effect of the weight of the portion. It is also possible to arrange an elastic arrangement (not shown) that operates on the portion 11 to promote this return.

The printing apparatus 1 can comprise, in particular, a first drive (in particular an electric motor, for example a step motor) to drive the movable blade 6 of the cutting device. The printing apparatus 1 can comprise, in particular, a second (electric) drive to drive the pusher 8 of the movement device. The printing apparatus 1 can comprise, in particular, a third drive for driving the printing device.

The printing apparatus 1 can comprise, in particular, the aforesaid programmable electronic control arrangement (comprising for example an electronic board connected to sensors and actuators of the printing apparatus) connected to the aforesaid drives.

The control arrangement operates until, after the printing apparatus 1 has printed a document, the first drive separates the document (situated in a cutting position) from the rest of the strip. After the document has been separated (still with the document situated in the cutting position), the second drive moves the pusher 8, which moves the document from the cutting position to the stacking position.

The printing apparatus 1 can comprise, in particular, program instructions that are implementable on this programmable controller to perform the following steps of a printing method.

A first step can comprise the step of printing (by the aforesaid printing device) the document on the strip that advances. A second step, following the first step, can comprise the step of separating (by the aforesaid cutting device) the document from the strip. A third step, following the second step, can comprise the step of moving the document to a stacking position. A fourth step can comprise the step of stopping the printing device, to prevent a jam if the sensor arrangement detects a movement of the movable portion 11, i.e. detects an anomalous situation of jam risk.

What is claimed is:

1. A printing apparatus comprising:

a path for a continuous strip;

a printing device for printing a document on the strip;

a cutting device for separating the document from the strip when the document is in a cutting position;

a movement device for moving the document from said cutting position to a stacking position, said movement device comprising a pusher that moves the document laterally from said cutting position to said stacking position;

an anti-jamming device comprising a movable portion that can adopt a normal position, in which it is arranged on one side of a part of said path, and an anomalous position, in which it is moved away from said part of said path, a movement of said movable portion from said normal position to said anomalous position being caused by a push of the strip that is deformed laterally because of an irregularity on said path;

a control arrangement for stopping the advancement of the strip and stopping said printing device when said movable portion adopts said anomalous position.

2. The apparatus according to claim 1, wherein said movable portion is arranged before said movement device, with reference to an advancement direction of the strip along said path to said cutting position.

3. The apparatus according to claim 1, wherein said movable portion is arranged after said cutting device, with reference to an advancement direction of the strip along said path to said cutting position.

4. The apparatus according to claim 1, in which:

said cutting device is arranged below said cutting position and below said movable portion;

the strip advances with a tilted direction upwards from a start to an end of said part of said path;

said movable portion is tilted and has a lower end nearer said cutting device and an upper end further from said cutting device;

said upper end is hinged and said lower end is free and rests against an abutment, a movement of said movable portion from said normal position to said anomalous position comprising a rotation around said upper end.

5. The apparatus according to claim 1, in which said anti-jamming device comprises a sensor arrangement for detecting said anomalous position of said movable portion.

6. The apparatus according to claim 5, wherein said sensor arrangement comprises at least one switch.

7. The apparatus according to claim 1, in which said printing device comprises a printing head and a printing roller coupled frontally with said printing head, said printing roller making the strip advance as far as said cutting position.

8. The apparatus according to claim 1, said pusher being arranged in contact on a face of the document for pushing in a direction that is transverse to said face, said pusher having a reciprocating motion with an outward stroke to move the document laterally to said stacking position and a return stroke for returning to a position that is suitable for moving the next document laterally.

9. The apparatus according to claim 1, comprising at least one movable stacking wall having an elastic arrangement for maintaining pressed the document situated in said stacking position against an abutting arrangement, said stacking wall being arranged for retracting, in opposition with said elastic arrangement, pushed by said movement device when the latter moves the document from said cutting position to said stacking position.

10. A printing method comprising the steps of:

printing a document on a strip that advances along a path by means of a printing device;

separating the document from the strip by means of a cutting device;

moving the document to a stacking position by means of a pusher that moves the document laterally to said stacking position;

interrupting an advancement of the strip and stopping said printing device if a movement is detected of a movable portion that is arranged adjacent to a part of said path arranged downstream of said cutting device, said movement being caused by the push of the strip that is deformed laterally because of an irregularity on said path.

11. A printing apparatus comprising:

a path for a continuous strip;

a printing device for printing a document on the strip;

a cutting device for separating the document from the strip when the document is in a cutting position;

a movement device for moving the document from said cutting position to a stacking position, said movement device comprising a pusher that moves the document laterally from said cutting position to said stacking position, said pusher being arranged in contact on a face of the document for pushing in a direction that is transverse to said face, said pusher having a reciprocating motion with an outward stroke to move the document laterally to said stacking position and a return stroke for returning to a position that is suitable for moving the next document laterally;

an anti-jamming device comprising a movable portion that can adopt a normal position, in which it is arranged on one side of a part of said path, and an anomalous position, in which it is moved away from said part of said path, a movement of said movable portion from said normal position to said anomalous position being caused by the strip that is deformed laterally because of an irregularity on said path;

control arrangement for stopping the advancement of the strip and stopping said printing device when said movable portion adopts said anomalous position.

* * * * *